United States Patent [19]

Stevens et al.

[11] 4,294,357

[45] Oct. 13, 1981

[54] POP UP ABRASIVE DISC DISPENSER

[75] Inventors: John H. Stevens, Germantown, Tenn.; Bruce A. Reidel, East Amherst, N.Y.

[73] Assignee: Kennecott Corporation, Stamford, Conn.

[21] Appl. No.: 110,878

[22] Filed: Jan. 10, 1980

[51] Int. Cl.[3] ..... B65D 85/67; B65D 85/672

[52] U.S. Cl. ..... 206/409; 51/406; 206/412; 206/445; 221/70; 242/1; 229/175

[58] Field of Search ..... 206/445, 409, 408, 412, 206/395; 229/17 S, 39 R, 38, 37 R; 225/52; 221/70; 51/406; 242/1

[56] References Cited

U.S. PATENT DOCUMENTS

| | | | |
|---|---|---|---|
| 1,897,143 | 2/1933 | Powell | 206/395 |
| 2,372,245 | 3/1945 | Avery | 229/17 S |
| 2,373,092 | 4/1945 | Avery | 229/17 S |
| 2,838,171 | 6/1958 | Kaspar | 206/409 |
| 2,912,140 | 11/1959 | Cole | 221/70 |
| 3,119,544 | 1/1964 | Cope et al. | 220/410 |
| 3,160,326 | 12/1964 | Sturdevant et al. | 222/183 |
| 3,182,793 | 5/1965 | Wright | 206/395 |
| 3,225,916 | 12/1965 | Field et al. | 206/445 |
| 3,267,623 | 8/1966 | Block | 206/445 |
| 3,365,134 | 1/1968 | Oberreich | 229/39 R |
| 3,727,827 | 4/1973 | Stice | 229/37 R |
| 3,756,471 | 9/1973 | Wissman | 222/185 |
| 3,849,949 | 11/1974 | Steinhauser et al. | 51/406 |
| 3,912,142 | 10/1975 | Steinhauser et al. | 225/52 |
| 3,958,768 | 5/1976 | Fairbank | 242/1 |

OTHER PUBLICATIONS

*Stikit® Disc Roll Dispenser,* Trade Literature of 3M Company.

*Primary Examiner*—William T. Dixson, Jr.
*Attorney, Agent, or Firm*—Paul A. Leipold

[57] ABSTRACT

The invention provides a container having a roll of abrasive adhesive discs releasably connected to a backing paper inside the container. The container is designed such that the discs and backing paper may be pulled from the upper front of the container and when the backing paper is pulled downward or outward over the front edge the abrasive discs release from the backing paper and are popped free and released from the backing paper while being presented for easy removal by the user without contamination of the adhesive surface. Alternatively, by pulling the backing generally upward from the device, the abrasive discs remain adhered to the backing paper and the backing paper can be cut or manually torn such that one or several of the discs may be pulled free from the device while remaining on the backing and removed to another work place for later use without risk of contamination of the adhesive backing.

21 Claims, 6 Drawing Figures

POP UP ABRASIVE DISC DISPENSER

FIELD OF THE INVENTION

This invention relates to an improved dispenser for dispensing abrasive discs from a backing strip.

PRIOR ART

Adhesive backed abrasive discs are utilized for attachment to orbital or rotary sanders. These discs are particularly useful for automotive body work. When used in this environment, their life is limited due to the difficult use and also the environment presents difficulties with storage and handling of the abrasive discs. The discs are not suitable for use if the adhesive backing is not sufficient to attach them to the orbital sander. Further, they cannot give a smooth finish if in release from the backing to which they are attached they are ripped or wrinkled.

It has been known in the art to supply abrasive discs on a roller dispenser in which the discs are connected at their edges to form a strip. The strip is drawn off the roll and severed by pulling over a toothed cutting device. This method presents difficulties in that the roll is exposed to dust and dirt prior to dispensing, and further when they are torn apart, there is a tendency to rip at the connecting line. If ripped at the connecting line their life is shortened or they cause scratches and are unsuitable for doing fine finishing work.

It is also known to supply abrasive discs with a crepe paper backing packed individually. Such discs are known to have the disadvantage that the backing is difficult to remove and the discs are not protected from becoming contaminated or scattered as they are not connected together.

There remains a need for a method of dispensing abrasive discs that will overcome the disadvantages of prior methods of furnishing adhesive-backed abrasive discs, particularly to the automotive trade for use with orbital sanders.

BRIEF DESCRIPTION OF THE INVENTION

It is an object of this invention to overcome disadvantages of prior processes of presenting adhesive-backed abrasive discs.

It is an object of this invention to provide dispensing of abrasive discs without their becoming dirty while stored.

It is another object of this invention to allow dispensing of abrasive discs without difficulties in removing their backing.

It is an additional object of this invention to allow ease of shipment and storage of adhesive-backed abrasive discs.

It is an additional further object of this invention to provide a device for shipping, storage and dispensing of adhesive-backed discs.

It is another object of this invention to provide a low-cost device for dispensing abrasive discs.

These and other objects of the invention are generally accomplished by providing a container having a roll of abrasive adhesive discs releasably connected to a backing paper inside the container. The container is designed such that the discs and backing paper may be pulled from the upper front of the container and when the backing paper is pulled downward or outward over the front edge the abrasive discs release from the backing paper and are popped free and released from the backing paper while being presented for easy removal by the user without contamination of the adhesive surface. Alternatively, by pulling the backing generally upward from the device, the abrasive discs remain adhered to the backing paper and the backing paper can be cut or manually torn such that one or several of the discs may be pulled free from the device while remaining on the backing and removed to another work place for later use without risk of contamination of the adhesive backing.

In a particularly preferred embodiment in accordance with the invention, the device comprises a cardboard box of generally rectangular dimensions having a bottom wall and four side walls with a top closure member hingedly connected to the back wall of said container. A flap connected to the top member extends downward about one half the vertical height into the box and separates the leading end of the roll of adhesive-backed discs from the rest of the roll. The top closure with the separating flap is held down either by tabs extending upward from the sides of the box into the top closure member or by latching devices or projections on the flap which are secured into holes in an inner member when the flap is closed. The roll of abrasive discs is placed in the container and when the closure member containing the flap is closed the roll of discs may be pulled from the box without opening the box and the discs either left on backing paper strips of the roll or if the backing paper is pulled downwardly over the front rim of the box, the discs are individually released from the backing paper and pop up as the roll is pulled from the box.

DETAILED DESCRIPTION OF THE INVENTION

The instant invention has numerous advantages over prior methods of providing adhesive-backed abrasive discs. The instant device provides the discs in a manner which assures that they are clean both on the abrasive surface and the adhesive backing. Further, the instant system allows the discs either to be dispensed without backing at the container or to be removed in multiple numbers from the container without exposing the adhesive backing and then transported from the container to the work place for removal. Another advantage of the instant device is that the dispenser itself may be easily moved to different locations so as to provide a dispenser where discs are needed. Another advantage of the instant system is that the shipping container and dispenser are one and the same thereby simplifying packaging and distribution. Further advantages of the system of the instant invention will become apparent from the following description of the drawings.

Figure 1:
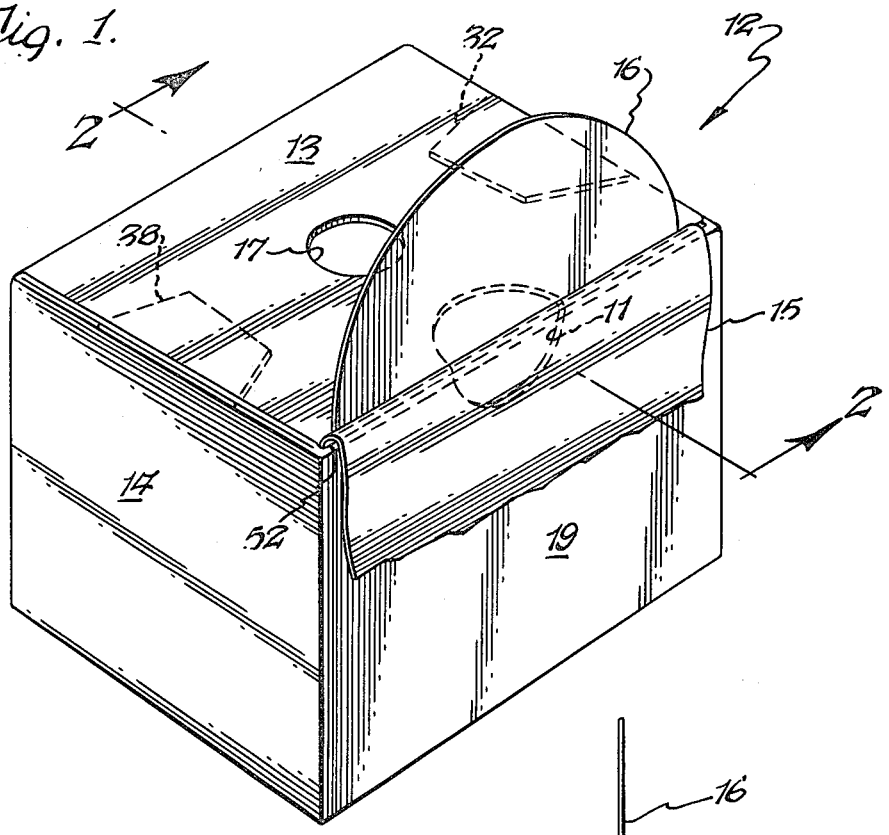
FIG. 1 is a perspective view of the device of the invention with one disc partially released or popped free from the backing member.
Figure 2:
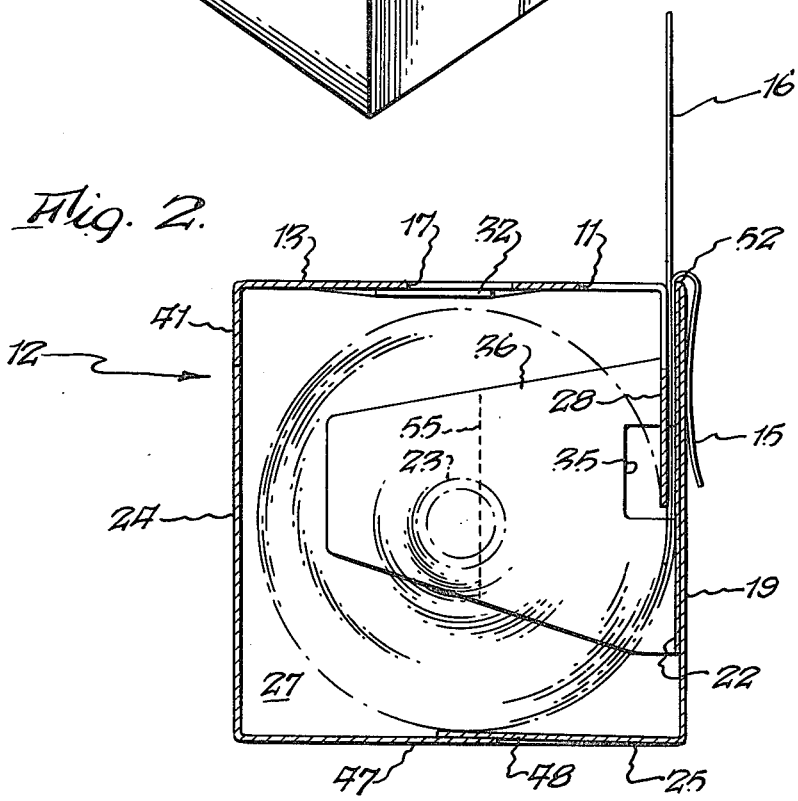
FIG. 2 is a vertical section taken on line II—II of FIG. 1.

As shown in FIGS. 1 and 2, the device of the invention comprises a generally rectangular container generally indicated by the numeral 12 having a bottom 25, rear wall 24, top closure member 13 and front wall 19. The container, generally indicated as 12, is adapted to unwind a roll 26 which is inside the container by upward pulling on the backing sheet 15 for release of discs 16. The roll 26 comprising backing paper 15 carrying discs 16 is pulled upward between flap 28 and the double thickness front wall. The major portion of the front wall is of double thickness having outer sheet 19 and inner sheet 22 which is formed by folding down and in on inner sheet 22 to leave a fold as the top edge 52. The roll 26 may have inner core 23 around which the carrying paper 15 is wrapped.

In the instant device, it is important that the top closure member 13 not move upward when the backing sheet 15 is pulled to release the discs 16. Therefore, the top closure member 13 is latched or fastened shut. In the device illustrated by FIGS. 1–3 and 5, the flap 28 is held in place by the insertion of projections 33 of the flap into the cutout 35 in member 36. Members 36 are in the form of ears which are extensions of the inner sheet 22 and extend along the side walls 14 and 27. When the device is closed, the projections 33 extend into the hole 35 aided by depressions 34 in the flap immediately above the projections 33.

The flap 28 must be of a length that will allow easy dispensing of the discs without catching of the discs onto the flap as they are pulled from the container 12. The flap generally extends downward to a point about at the middle of the full roll 26. In the preferred embodiment this is about one half the vertical height of the box for best dispensing with no premature separation of disc from backing sheet, good carbon strength and with sufficient resistance to allow tear off along the upper front edge of the container.

It is within the scope of the invention to double or fold ears 36 so as to decrease the area for insertion of a roll in the event a smaller roll is desired for use in the same container. This is practiced when dispensing five inch discs in a box which is also suitable for six inch discs.

Figure 4:
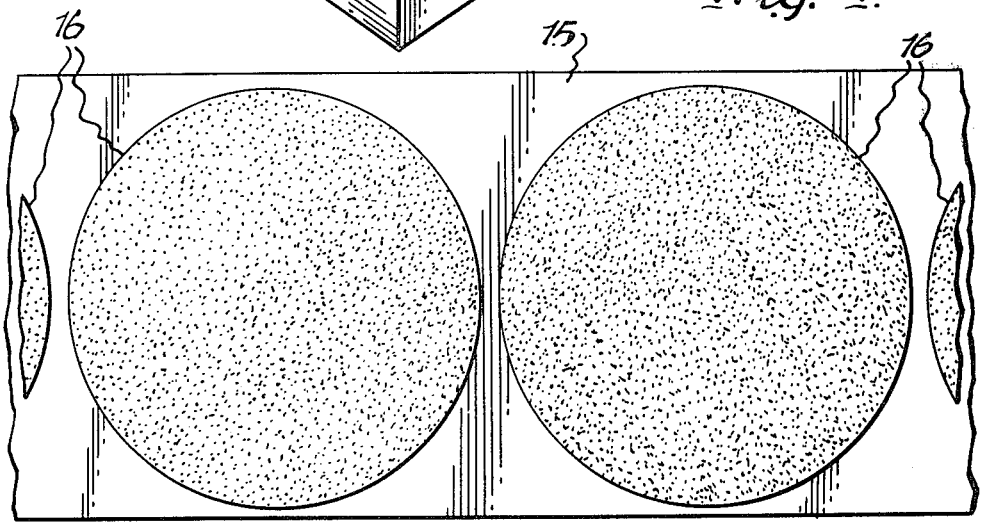
FIG. 4 is a fragmentary top view of the dispensing strip with two abrasive discs thereon.

FIG. 4 illustrates a backing sheet having a plurality of discs 16 spaced thereon. The backing sheet 15 generally is formed of a paper that is coated on the surface where the discs are releasably adhered with a release material to which the adhesive discs do not completely adhere. Such paper is commonly called release paper. Such coatings are known in the paper art and may be waxy or flourine containing release coatings. The coating is adapted such that the adhesive side of the disc will be secured to the paper but released when the paper is pulled away from the disc at a sharp angle. The paper being more flexible than the disc releases as the beam strength of the disc as it comes from the box is great enough that it has a strong tendency to remain straight when the paper is sharply angled away by being pulled generally downward over the front edge 52. The front edge 52 is preferably formed by bending over a perforated fold line 30 that has been cut at about one quarter inch intervals with about one quarter inch cuts. The cuts after folding create an area of lands and valleys on edge 52 which acts as a serrated edge to aid in cutting off the paper backing. It is within the invention to use a metal toothed edge for tear off. However, it is preferred not to as the above described preferred edge is satisfactory and of lower cost.

The top closure member has holes or cut outs 11 and 17. These cut outs enable both ease of hand gripping of the device for transportation and use and further allow sighting of the remaining roll within the box to determine how much is left. The device as illustrated also has a flap 41 formed by cutting on line 44. The flap 41 is hingedly connected along hinge line 20 where top closure member 13 pivots to close the container 12. The cut out or hole 44 allows gripping of the box from the rear portion with the fingers while the thumb is placed in the center hole 17. The flap 41 remains generally in alignment with the rear wall 24 to provide protection for the roll from dust when it is not being carried. The top closure member 13 is supported so as to hinder its being crushed downward onto the roll 26 by tabs 32 and 38 which fold inward from side walls 27 and 14 respectively. The cut out 11 extends across the fold line 40 between top member 13 and flap 28. The hole 11 enables the discs 16 and backing paper 15 to be easily retrieved if the free end drops slightly back into the container 12 after tear off along edge 52. The user can easily insert a finger into the cut out 11 and by pressing against the front of the container pull up the end.

Figure 3:
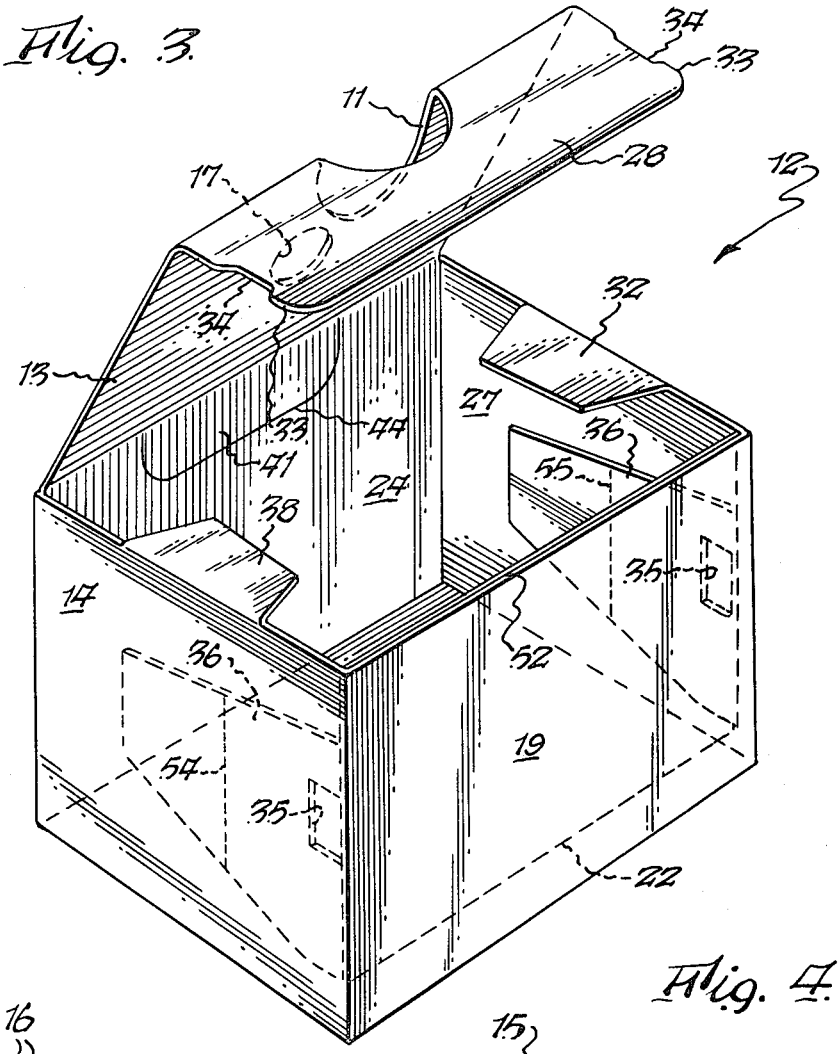
FIG. 3 is a perspective view of the dispensing device showing the top closure and the flap in the open position.
Figure 5:
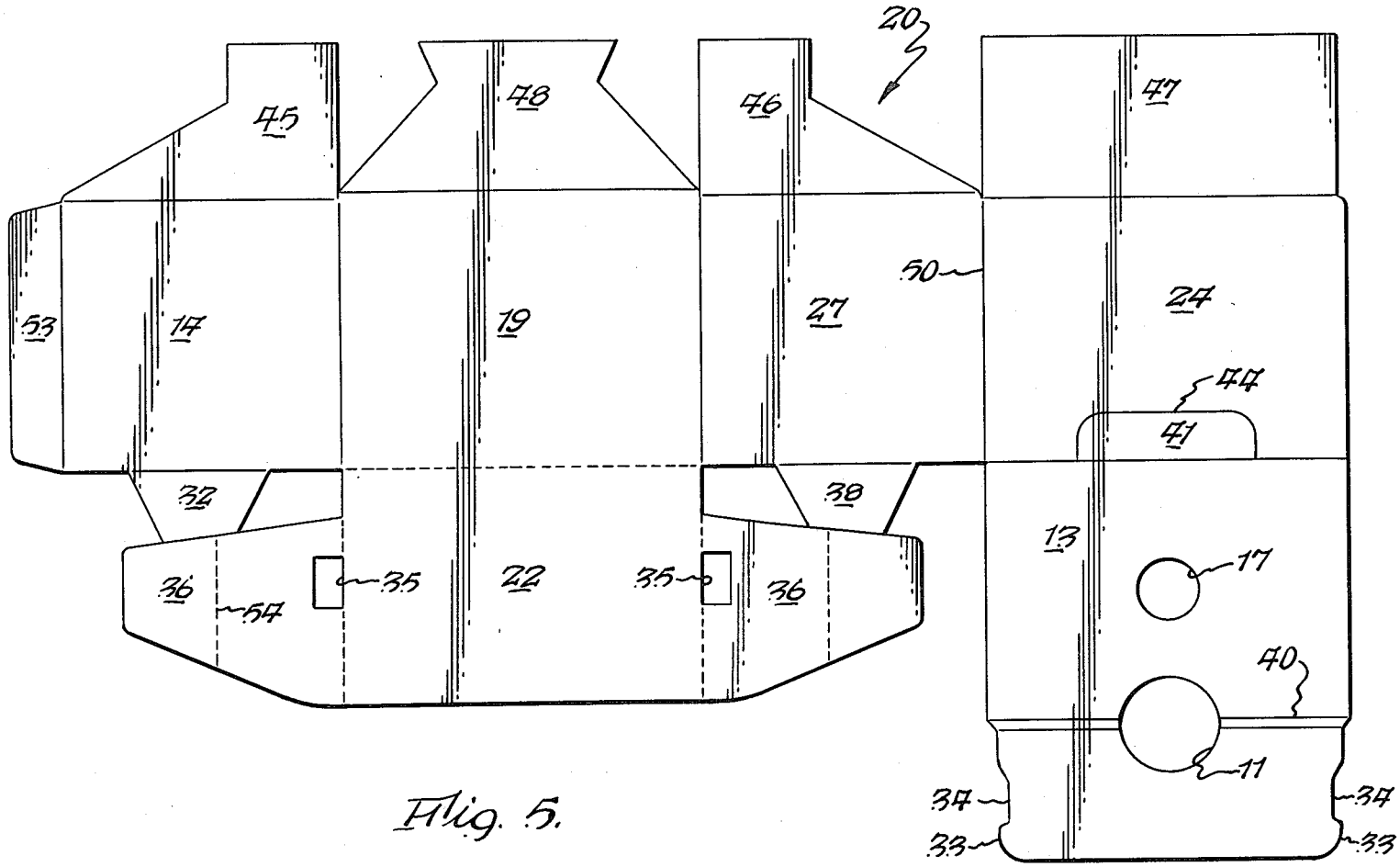
FIG. 5 is a plan view of a container blank showing the preferred embodiment of the dispensing device of the invention wherein the flap on the closure member has projections which serve as latching means to hold the top closed during dispensing.

Referring specifically to the blank 20 of FIG. 5 which forms the container of FIGS. 1–3, there is illustrated with fold lines generally indicated such as at 50 the device of the invention. While the blank generally formed from cardboard is utilized to form a container with a single bottom, the bottom is formed of four flaps 45, 46 and 47 which are held together by latching flap 48 to form a single surface. The sides 14 and 27 join the front 19 and rear wall 24 when gluing tab 53 is glued to the rear wall at 24. Fold lines 54 and 55 may be utilized when the interior area of the box is desired to be narrowed by folding these tabs in order to minimize side movement of the roll. Along what will be edge 52 are illustrated the cuts 30 that form the rough tearing edge.

Figure 6:
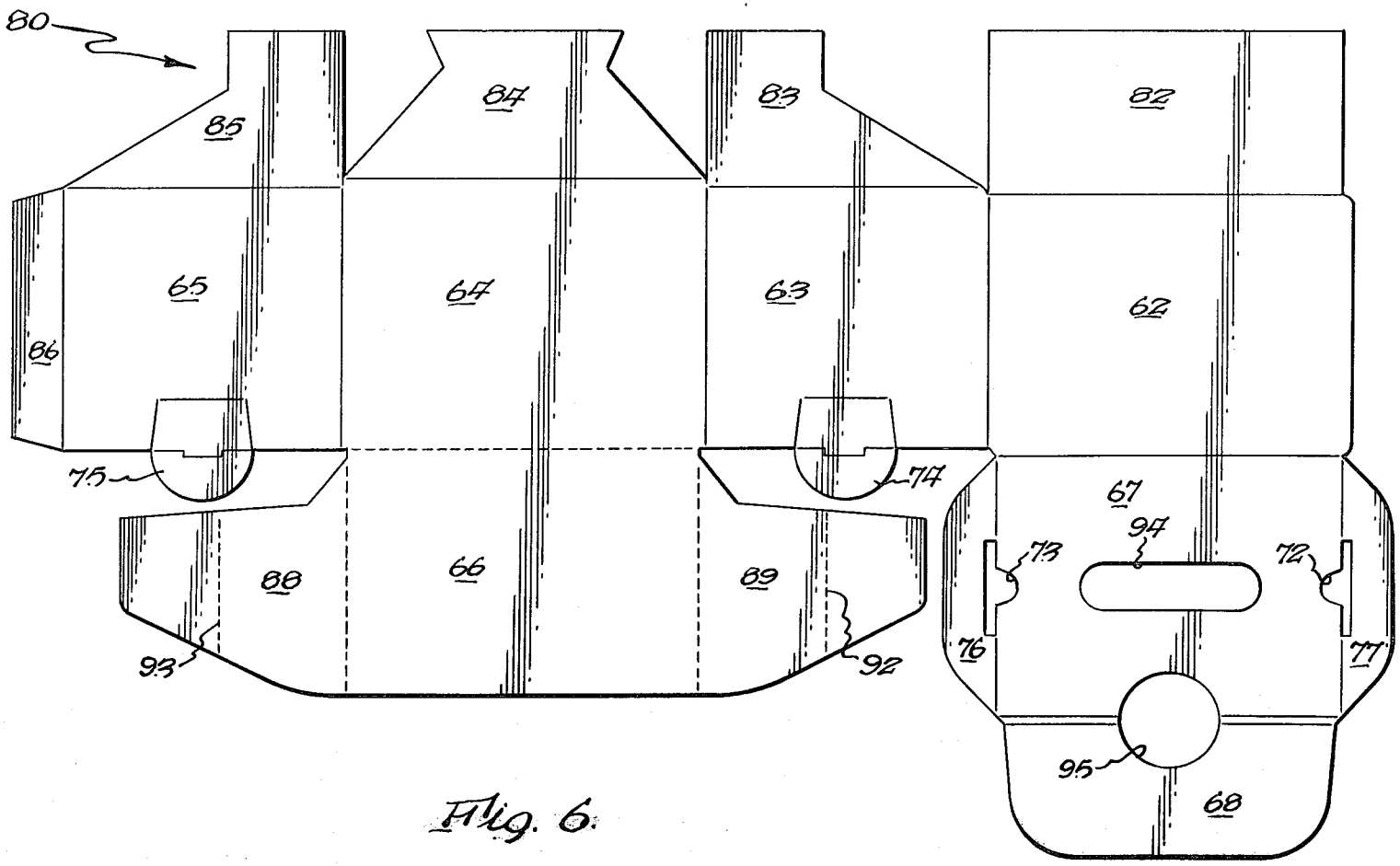
FIG. 6 is a plan view of a blank showing an alternative construction of the dispensing means of the invention wherein flaps extending from the side walls can be placed into locking slots formed in the top closure member to hold the top closure member in place during dispensing and shipping.

FIG. 6 illustrates an alternative blank 80 for forming a modified device in accordance with the instant invention. The device formed by the blank of FIG. 6 utilizes an alternative way of holding the top member of the device against opening when the roll carrying the abrasive discs is pulled from the container. The blank of FIG. 6 includes panels to form a back wall 62, side walls 63 and 65 and a front wall 64. The side walls are joined by gluing tab 86 to the wall 62. The bottom is formed by joining pieces 82, 83 and 85 with latching member 84 to form the bottom. The top closure member 67 has hole or cut outs 94 and 95 to provide hand holes for carrying the container and for sighting the amount of roll remaining. The blank has cut outs 72 and 73 and downturn tabs 77 and 76. The cut outs 72 and 73 in combination with the downturn tabs 76 and 77 provide a closure means by insertion of tab 74 into slot 73 and tab 75 into slot 72. Slot 68 provides a separating mechanism betweeen the front wall 64 and the roll being drawn from the container. Front wall 64 is made of double thickness by folding sheet 66 against the front wall and ear members extend back along the side walls. The ear members 88 and 89 may alternatively be folded at 92 and 93 to provide further thickness and narrow the interior of the container somewhat for use with narrower rolls of adhesive discs. The cuts 60 form the roughened edge 52 for tearing off the backing paper.

While the system of the invention has been illustrated with two methods of securing the top closure, it is within the invention to use several other known methods of fastening the lid of a device. Further, while the carrying holes have been shown as round in the preferred embodiment, it is within the invention to form the carrying holes to be oblong such as in 94 or to locate the carrying cut outs at different locations. Further, it is within the invention to include a cut out portion on one side of the container for sighting the height of the roll 26 remaining.

The flaps 28 and 68 have been shown as about half the depth of the container or stated differently the flaps are about the radius of roll 26. This depth is considered to be important as the flap being about half the depth of the device allows feeding of the roll from the box without separating the abrasive disc from the backing within the container. Too short a flap or a flap that extended almost to the bottom of the container would ordinarily risk separation of the backing paper 15 from the abrasive disc 16 prior to its being drawn over the edges 52 or 60.

The system of the invention may be utilized to dispense any size and grit of abrasive disc. The preferred use is for 5" and 6" diameter discs with grit size ranging from 80 to 320. The roll may include between 125 and 250 abrasive discs per roll.

While the preferred material for the device of the invention is cardboard, particularly the cardboard with a corrigated center, it is within the invention to form the device from other materials such as plastics or metal. Such materials might be desirable in the use of abrasive discs in wet areas or corrosive environments where it would be desirable to protect them until dispensing. Further, while the device of the invention finds its preferred use in dispensing of abrasive discs, the system of the invention would be suitable for dispensing other materials such as labels or foods that may be carried on a flexible backing material. The flexible backing material itself may be of a material other than paper, such as plastic films.

The invention has been described with reference to particular embodiments thereof, but it will be understood that variations and modifications may be effected within the spirit and scope of the claims that appear below. For instance, while described as a dispenser with the discs and paper backing being pulled from the top of the dispenser, it is, of course, within the invention to orient the device such that the release paper is exiting to the side or downward.

What is claimed is:

1. A device for shipping, storage, protection and dispensing of abrasive discs comprising, a rectangular box having a bottom, a front wall, a back wall, two side walls and a top closure member connected with each other to define a container, said top closure means hingedly connected to the back wall of said container, a flap hingedly connected to the portion of said top closure adjacent said front wall and extending into said container adjacent to the front wall of said container, a roll, comprising abrasive discs, said discs having an abrasive surface and an adhesive surface releasably adhered on said adhesive surface to a continuous flexible backing, said roll being rolled such that the abrasive surface of said discs faces toward the center of said roll, arranged such that the outer end of said roll extends between said flap and said front wall.

2. The device of claim 1 wherein said side walls have inwardly extending tabs at their upper edge that act to support said top.

3. The device of claim 1 wherein said front wall is reinforced.

4. The device of claim 1 wherein means are provided to secure said top closure in the closed position.

5. The device of claim 4 wherein said means to secure said top closure are tabs extending from the side walls and adapted to be connected to said top.

6. The device of claim 4 wherein said means to secure said top comprises projections on said flap adapted to be secured to inner ears that extend along at least a portion of the inside of the side walls.

7. The device of claim 1 wherein said front wall is formed of a double thickness of the material forming said device.

8. The device of claim 7 wherein said front wall is a folded sheet with the fold forming the top edge.

9. The device of claim 1 wherein said front wall is a folded sheet with the fold forming the top edge of said wall and wherein the inner layer of said front wall has ears which extend along the inner portion of the side walls and wherein said flap is adapted to be fastened to said ears.

10. The device of claim 1 wherein said back wall and said top are provided with holes adapted to aid in carrying and gripping said device.

11. The device of claim 10 wherein said hole in said top is adapted to serve both as a thumb grip and to sight the size of said roll remaining.

12. The device of claim 10 wherein said hole in said back wall is hingedly covered by the portion of said box partially cut free to form the hole.

13. The device of claim 7 wherein the top edge of said front wall is roughened by spaced cuts which are along the fold line prior to folding.

14. The device of claim 1 wherein said flap extends downward into said container to about the middle of said roll.

15. The device of claim 1 wherein said flap extends downward into the container about one half the distance to the bottom of said container.

16. A blank for container formation comprising a first generally rectangular panel, a second generally rectangular panel joined to said first panel at a fold line, a third generally rectangular panel joined to said second panel at a fold line on the opposite edge of said second panel from said fold line joining said first and said second panel, a fourth generally rectangular panel joined to said third panel by a fold line on the opposite edge of said third panel from said fold line where said third panel joins said second panel, four bottom forming members attached to adjacent edges of said first, said second, said third and said fourth panel, a fifth generally rectangular panel attached by a fold line to the opposite edge of said fourth panel from a fold line where said bottom member is attached, a sixth panel attached by a fold line to the opposite edge of said fifth panel from said fold line where said fifth panel is attached to said fourth panel, a seventh generally rectangular panel attached to said second panel on the edge opposite a fold line where the bottom panel is attached to said second panel, two smaller panels attached at fold lines to a portion of the two edges adjacent the fold line where said second panel joins said seventh panel, a gluing panel attached by a fold line to the opposite edge of said first panel from said fold line where said first panel joins said second panel and tab panels connected to said first and third panels at fold lines on the opposite edge of said first and third panels from said bottom forming members.

17. The blank of claim 16 wherein said sixth panel is of about one half the surface area of said fifth panel.

18. The blank of claim 16 wherein said fifth panel has a hole in about the middle.

19. The blank of claim 16 wherein said fourth panel has a generally rectangular flap cut such that said fold line between said fourth and fifth panel is the hinge and attachment area.

20. The blank of claim 16 wherein there is a hole bridging said fifth and sixth panels in about the middle of said fold line between said panels.

21. The blank of claim 16 wherein said two smaller panels adjacent said seventh panel have holes that are adjacent said fold line joining said smaller panels to said seventh panel.

* * * * *